US005274925A

United States Patent [19]

Campbell et al.

[11] Patent Number: 5,274,925

[45] Date of Patent: Jan. 4, 1994

[54] CROSS HAIR ADJUSTER FOR ARCHERY BOW

[76] Inventors: Elwood M. Campbell, R.R. #1, Evansville Ontario, Canada, P0P 1E0; George Spector, 233 Broadway Rm 702, New York, N.Y. 10279

[21] Appl. No.: 991,414

[22] Filed: Dec. 16, 1992

[51] Int. Cl.[5] ..... F41G 1/467; F41G 1/38

[52] U.S. Cl. ..... 33/265; 33/246; 33/298

[58] Field of Search ..... 33/265, 298, 245, 246, 33/247, 252, 254; 124/87

[56] References Cited

U.S. PATENT DOCUMENTS

| | | | |
|---|---|---|---|
| 499,160 | 6/1893 | Cummins | 33/246 |
| 886,722 | 5/1908 | Neumayer | 33/246 |
| 1,949,100 | 2/1934 | Fahrenwald | 33/246 |
| 2,427,516 | 9/1947 | Unertl et al. | 33/298 |
| 3,777,404 | 12/1973 | Oreck | 33/245 |
| 4,297,789 | 11/1981 | Tominaga | 33/246 X |
| 5,025,565 | 6/1991 | Stenerson et al. | 33/245 X |

FOREIGN PATENT DOCUMENTS

| | | | |
|---|---|---|---|
| 715 | of 1902 | United Kingdom | 33/252 |

*Primary Examiner*—William A. Cuchlinski, Jr.
*Assistant Examiner*—Alvin Wirthlin

[57] ABSTRACT

A sight scope for an archery bow is provided which consists of a telescopic tubular housing having a first segment mounted to a handle of the archery bow, so that a viewing end of the first segment can be positioned in front of an eye of an archer, with a second segment of the archery bow being adjustable thereto. A cross hair is carried within the first segment of the telescopic tubular housing. A structure is for adjusting the height of the cross hair with respect to the adjusted length between the first and second segments of the telescopic tubular housing, so that the archer can focus on a target to try to hit the target with an arrow.

3 Claims, 1 Drawing Sheet

CROSS HAIR ADJUSTER FOR ARCHERY BOW

BACKGROUND OF THE INVENTION

The instant invention relates generally to sighting devices and more specifically it relates to a sight scope for an archery bow, which provides an archer the ability to adjust a cross hair to focus on a target, so that an arrow can hit the target.

There are available various conventional sighting devices which do not provide the novel improvements of the invention herein disclosed.

SUMMARY OF THE INVENTION

A primary object of the present invention is to provide a sight scope for an archery bow that will overcome the shortcomings of the prior art devices.

Another object is to provide a sight scope for an archery bow that will allow an archer to adjust a cross hair within the sight scope to focus on a target, so that the archer can try to hit the target with an arrow.

An additional object is to provide a sight scope for an archery bow in which changes in the conventional focusing mechanism automatically effect related cross hair adjustments.

A further object is to provide a sight scope for an archery bow that is simple and easy to use.

A still further object is to provide a sight scope for an archery bow that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
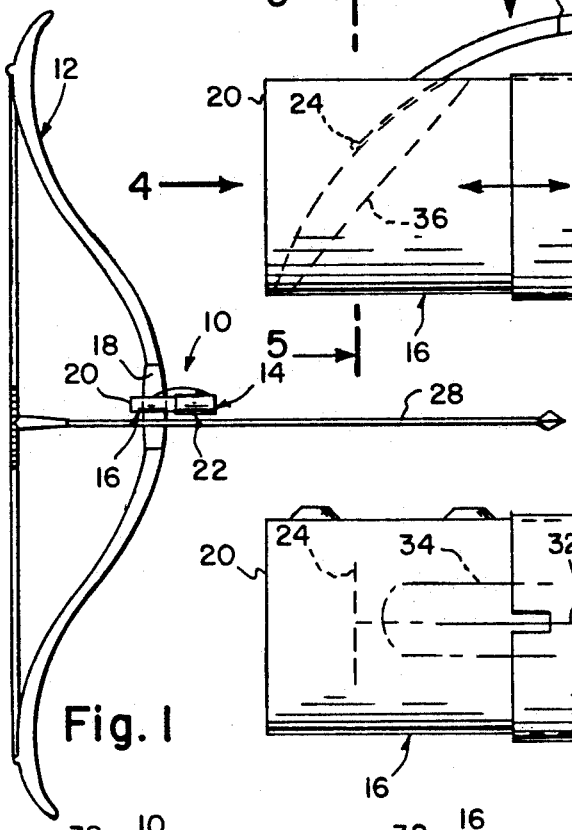
FIG. 1 is an elevational view of an archery bow with the instant invention mounted to the handle.
Figure 2:
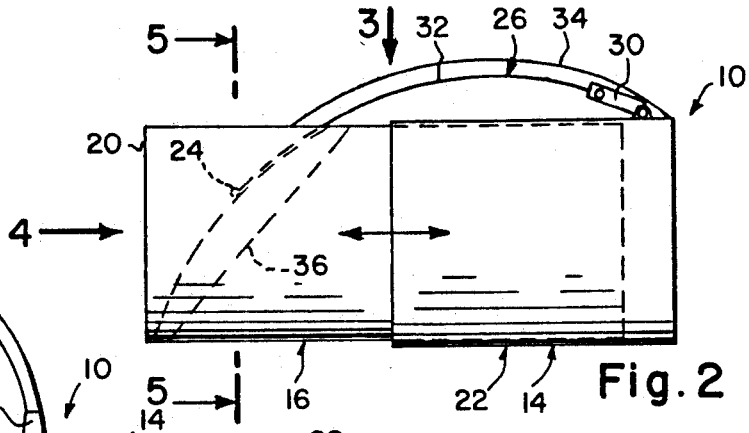
FIG. 2 is an enlarged diagrammatic elevational view of just the instant invention per se.
Figure 3:
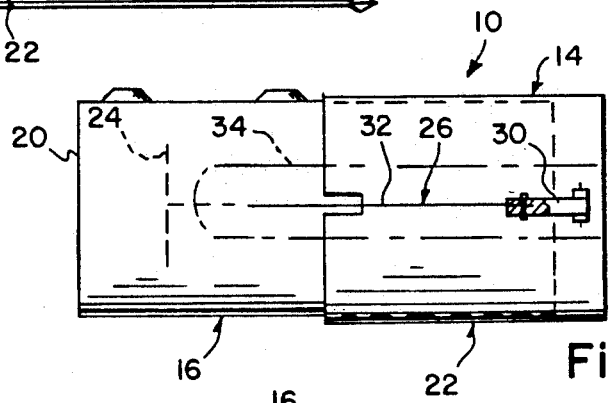
FIG. 3 is a diagrammatic view taken in direction of arrow 3 in FIG. 2, with the cover shown in phantom.
Figure 4:
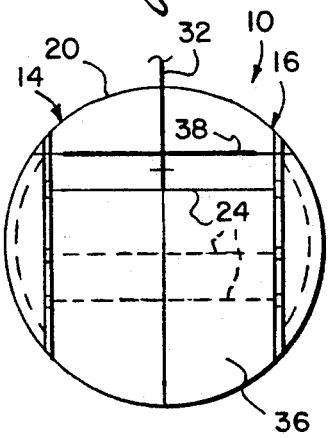
FIG. 4 is a diagrammatic end view taken in direction of arrow 4 in FIG. 1, looking therethrough to see the cross hair in different positions on the cross hair support.

Turning now descriptively to the drawings, in which similar reference characters denote similar elements throughout the several views, the Figures illustrate a sight scope 10 for an archery bow 12 which consists of a telescopic tubular housing 14, having a first segment 16 mounted to a handle 18 of the archery bow 12, so that a viewing end 20 of the first segment 16 can be positioned in front of an eye of an archer, with a second segment 22 of the archery bow being adjustable thereto. A cross hair 24 is carried within the first segment 16 of the telescopic tubular housing 14. A structure 26 is for adjusting the height of the cross hair 24 with respect to the adjusted length between the first and second segments 16, 22 of the telescopic tubular housing 14, so that the archer can focus on a target to try to hit the target with an arrow 28.

The adjusting structure 26 contains a pivotable bracket 30 mounted onto the second segment 22 of the telescopic tubular housing 14. A curved flexible leg 32 has a first end secured to the pivotable bracket 30 with a second end extending into the first segment 16 of the telescopic tubular housing 14. A cover 34 is positioned over the pivotable bracket 30 and the curved flexible leg 32. A cross hair support 36 is carried within the first segment 16 of the telescopic tubular housing 14. A cross hair adjuster 38 is connects the second end of the flexible leg 32 to the cross hair 24, so that the cross hair 24 can ride on the cross hair support 36, as described below in connection with FIGS. 5, 6 and 7.

Figure 5:
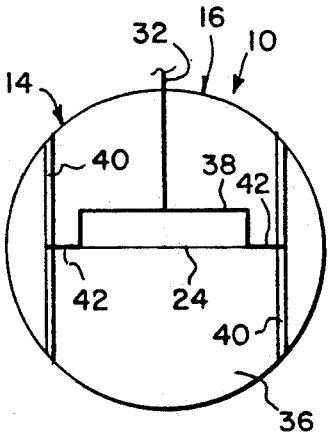
FIG. 5 is a diagrammatic cross sectional view taken along line 5—5 in FIG. 2 of a modification wherein a cross hair adjuster carries the cross hair along straight tracks on a support with the cross hair aligned.

A first modification, as shown in FIG. 5, includes the cross hair support 36 having a pair of spaced apart parallel tracks 40 therein. The cross hair adjuster 38 has a pair of opposite offset arms 42 thereon, to ride within the tracks 40 with the cross hair 24 aligned with the arms 42.

Figure 6:
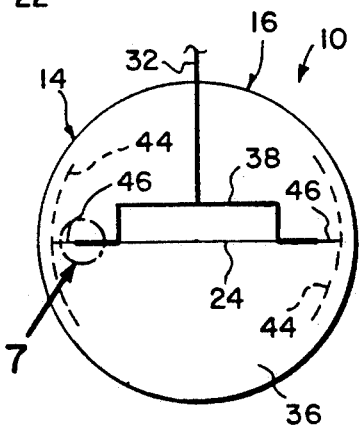
FIG. 6 is a diagrammatic cross sectional view similar to FIG. 5, showing another modification in which spring biased telescopic arms ride within curved tracks in a wall of the tubular housing.
Figure 7:
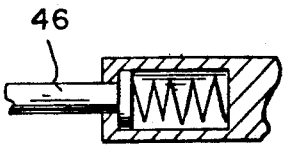
FIG. 7 is an enlarged cross sectional view as indicated by arrow 7 in FIG. 6, showing one of the spring biased adjustable arms in greater detail.

A second modification, as shown in FIG. 6 and 7, includes an inner wall of the first segment 16 of the telescopic tubular housing 14 having a pair of spaced apart curved tracks 44 therein. The cross hair adjuster 38 has a pair of opposite offset spring biased telescopic arms 46 thereon to ride within the tracks 44 with the cross hair 24 aligned with the arms 46.

In use, the sight scope 10 is adjusted to focus on the target, whereby segments 16 and 22 extend or contract relative to each other thereby causing leg 32 to move cross hair adjuster 38 along support 36 in a direction depending upon extension or contraction of the sight scope 10. Accordingly as seen in FIGS. 5 and 6, cross hair 24 will move up and down in linear tracks 40 or curved tracks 44, in which case spring biased arms 46 will adjust to the proper chord length.

Thus it is seen that focus adjustment, contracts or expands the sight scope length which in turns causes an appropriate cross hair adjustment for the proper range to the target.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A sight scope for an archery bow which comprises:

a) a telescopic tubular housing having a first segment mounted to a handle of the archery bow, so that a viewing end of the first segment can be positioned in front of an eye of an archer, with a second segment of said housing being adjustable thereto;

b) a cross hair carried within the first segment of said telescopic tubular housing; and c) adjusting means for adjusting the height of said cross hair with respect to the adjusted length between the first and second segments of said telescopic tubular housing, so that the archer can focus on a target to try to hit the target with an arrow; wherein said adjusting means includes:

d) a pivotable bracket mounted onto the second segment of said telescopic tubular housing;

e) a curved flexible leg having a first end secured to said pivotable bracket with a second end extending into the first segment of said telescopic tubular housing;

f) a cover positioned over said pivotable bracket and said curved flexible leg;

g) a cross hair support carried within the first segment of said telescopic tubular housing; and h) a cross hair adjuster connecting the second end of said flexible leg to said cross hair, so that said cross hair can ride on said cross hair support.

2. A sight scope for an archery bow as recited in claim 1, further including:

a) said cross hair support having a pair of spaced apart parallel tracks therein; and b) said cross hair adjuster having a pair of opposite offset arms thereon to ride within said tracks with said cross hair aligned with said arms.

3. A sight scope for an archery bow as recited in claim 1, further including:

a) an inner wall of said first segment of said telescopic tubular housing having a pair of spaced apart curved tracks therein; and b) said cross hair adjuster having a pair of opposite offset spring biased telescopic arms thereon to ride within said tracks with said cross hair aligned with said arms.

* * * * *